US010538867B2

(12) United States Patent
Kongo

(10) Patent No.: US 10,538,867 B2
(45) Date of Patent: Jan. 21, 2020

(54) SEWING MACHINE

(71) Applicant: Janome Sewing Machine Co., Ltd., Hachioji-shi, Tokyo (JP)

(72) Inventor: Takeshi Kongo, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 61 days.

(21) Appl. No.: 15/884,710

(22) Filed: Jan. 31, 2018

(65) Prior Publication Data

US 2018/0245254 A1 Aug. 30, 2018

(30) Foreign Application Priority Data

Feb. 28, 2017 (JP) ..... 2017-035791

(51) Int. Cl.
*D05B 19/10* (2006.01)
*D05B 21/00* (2006.01)

(52) U.S. Cl.
CPC ..... *D05B 19/10* (2013.01); *D05B 21/00* (2013.01)

(58) Field of Classification Search
CPC ..... D05B 19/08; D05B 19/10; D05B 19/12; D05B 19/14; D05B 19/16; D05B 21/00
USPC ..... 700/136–138
See application file for complete search history.

(56) References Cited

U.S. PATENT DOCUMENTS 7,493,867 B2 * 2/2009 Asano ..... D05B 19/08 112/470.01
8,733,260 B2 * 5/2014 Takahata ..... D05C 5/04 112/78
2006/0219141 A1 10/2006 Yoshimura et al.

FOREIGN PATENT DOCUMENTS

JP 2006271598 A 10/2006

* cited by examiner

*Primary Examiner* — Nathan E Durham
(74) *Attorney, Agent, or Firm* — Nath, Goldberg & Meyer; Jerald L. Meyer; Stanley N. Protigal

(57) ABSTRACT

A sewing machine includes a embroidery frame that moves horizontally while stretching and supporting a sewing object, a needle bar that supports a needle that penetrates a needle thread in the sewing object, and that reciprocally moves relative to the sewing object stretched by the embroidery frame, and a control device that controls the horizontal movement of the embroidery frame and the reciprocal motion of the needle bar. This control device includes a line input unit that accepts selection of the motif and input of a line which the motifs are arranged on in sequence. In addition, the control device horizontally moves the embroidery frame a way that the motifs selected using the line input unit are arranged in sequence on the sewing object along the line.

8 Claims, 10 Drawing Sheets

SEWING MACHINE

CROSS-REFERENCE TO RELATED APPLICATION

This application is based upon and claims the benefit of priority from Japan Patent Application No. 2017-035791, filed on Feb. 28, 2017, the entire contents of which are incorporated herein by reference.

FIELD OF THE INVENTION

The present disclosure relates to a sewing machine that includes an embroidery frame.

BACKGROUND

Sewing machines cooperatively drives a needle bar that supports a needle which a needle thread is inserted, a shuttle that houses a bobbin which a bobbin thread is wound around, and a feed dog that feeds a sewing object, such as a cloth and a leather, and performs a so-called ordinary sewing on the sewing object. The ordinary sewing continuously arranges motifs, such as straight, zig-zag, and decorative patterns, in the feeding direction by the feeding of the feed dog and by the change of the feeding direction by the user's hand, and keeps sewing until the user inputs stop instruction.

When an embroidery frame that stretches and supports the sewing object, and a motor that horizontally moves the embroidery frame in parallel with the plane of the bed unit are added to the sewing machine, the sewing machine is able to perform a so-called embroidery sewing on the sewing object. According to the embroidery sewing, it is unnecessary for the user to manually turn the sewing object to change the direction, and the embroidery frame is moved in accordance with embroidery data created beforehand, the embroidery pattern indicated by the embroidery data is formed on the sewing object, and the sewing is completed when the embroidery data is all executed.

The ordinary sewing has an advantage that sewing can be performed with flexibility and a preparation for setting the arrangement of motifs in the sewing machine is unnecessary, since the user can freely change the direction the motifs are arranged during the sewing. However, since the direction the motifs are arranged is changed by the user by manually turning the sewing object, the user's skill and concentration are required to precisely achieve the sewing imaged by the user.

The embroidery sewing has an advantage that the user's skill and concentration are unnecessary to precisely achieve the sewing imaged by the user, since the embroidery frame is moved in accordance with the embroidery data and the user's manual operation is unnecessary. Conversely, embroidery sewing needs a preparation to create the embroidery data that indicates the sewing imaged by the user before the sewing.

For example, the user may wish to sew an applique to the sewing object by zig-zag sewing. In the case of ordinary sewing, the user needs to continuously and precisely turn the sewing object in accordance with the contour of the applique. In the case of the embroidery sewing, the user needs to create the embroidery data in accordance with the contour of the applique by a data inputting device, etc., beforehand.

The present disclosure has been proposed in order to address the technical problems of above mentioned conventional technologies, and an objective is to provide a sewing machine which does not need a preparation to create embroidery data before sewing, and which can easily achieve a embroidery imaged by a user.

SUMMARY OF THE INVENTION

In order to accomplish the above objective, a sewing machine according to an aspect of the present disclosure includes:

a embroidery frame that moves horizontally while spreading and supporting a sewing object;

a needle bar that supports a needle which inserts a thread to the sewing object, and that reciprocally moves relative to the sewing object stretched by the embroidery frame;

a control unit that controls the horizontal movement of the embroidery frame and the reciprocal motion of the needle bar; and an input unit that accepts selection of a motif and input of a line which the motifs are arranged in sequence, in which the control unit horizontally moves the embroidery frame in a way that the motifs are arranged in sequence on the sewing object along the line.

The motif may be a straight, zig-zag, or decorative pattern.

The input unit may include a touch panel screen, and accepts designation of points on the touch panel screen, and the control unit may horizontally move the embroidery frame so as to arrange the motifs in sequence on the sewing object along the shape of the line that connects the designated points.

The input unit may include a jog key that horizontally moves the embroidery frame in response to a user operation, and further accepts designation of points on the sewing object indicated by the needle, and the control unit may horizontally move the embroidery frame so as to arrange the motifs in sequence on the sewing object along the shape of the line that connects the indicated points.

When the input unit accepts designation of an additional point while arranging the motifs on the sewing object, the control unit may horizontally move the embroidery frame so as to arrange the motifs in sequence on the sewing object along the shape of the line extended toward the additional point.

When the input unit accepts designation of an additional point after arrangement of motifs along the shape of the line has been completed, the control unit may restart the horizontal movement of the embroidery frame and the reciprocal motion of the needle bar so as to arrange the motifs in sequence on the sewing object along the shape of the line extended toward the additional point.

The control unit may include a creating unit that creates embroidery data which is the motifs arranged in sequence along the shape of the line, and an actuator that horizontally moves the embroidery frame in accordance with the embroidery data.

The control unit may include a creating unit that creates embroidery data file containing embroidery data which is the motifs arranged in sequence along the shape of the line, and an actuator that horizontally moves the embroidery frame in accordance with the embroidery data contained in the embroidery data file, in which the creating unit may create, when the input unit accepts designation of an additional point, the embroidery data that is the motifs arranged in sequence in an extended segment up to the additional point, and add the created embroidery data to the embroidery data file.

The control unit may include a memory unit that stores embroidery data file containing embroidery data of a pattern, a creating unit that creates the embroidery data which has the motifs arranged in sequence along the shape of the line, and which adds the created embroidery data to the embroidery data file; a display unit that displays the rendered pattern indicated by the embroidery data file; and an actuator that horizontally moves the embroidery frame in accordance with the embroidery data contained in the embroidery data file.

According to the present disclosure, a user is not required to prepare to create embroidery data before sewing, and can easily achieve a embroidery imaged by the user without the skill and the concentration.

DETAILED DESCRIPTION OF THE EMBODIMENTS

A sewing machine according to each embodiment of the present disclosure will be described in detail with reference to the figures.

(First Embodiment)

(Entire Structure)

Figure 1:
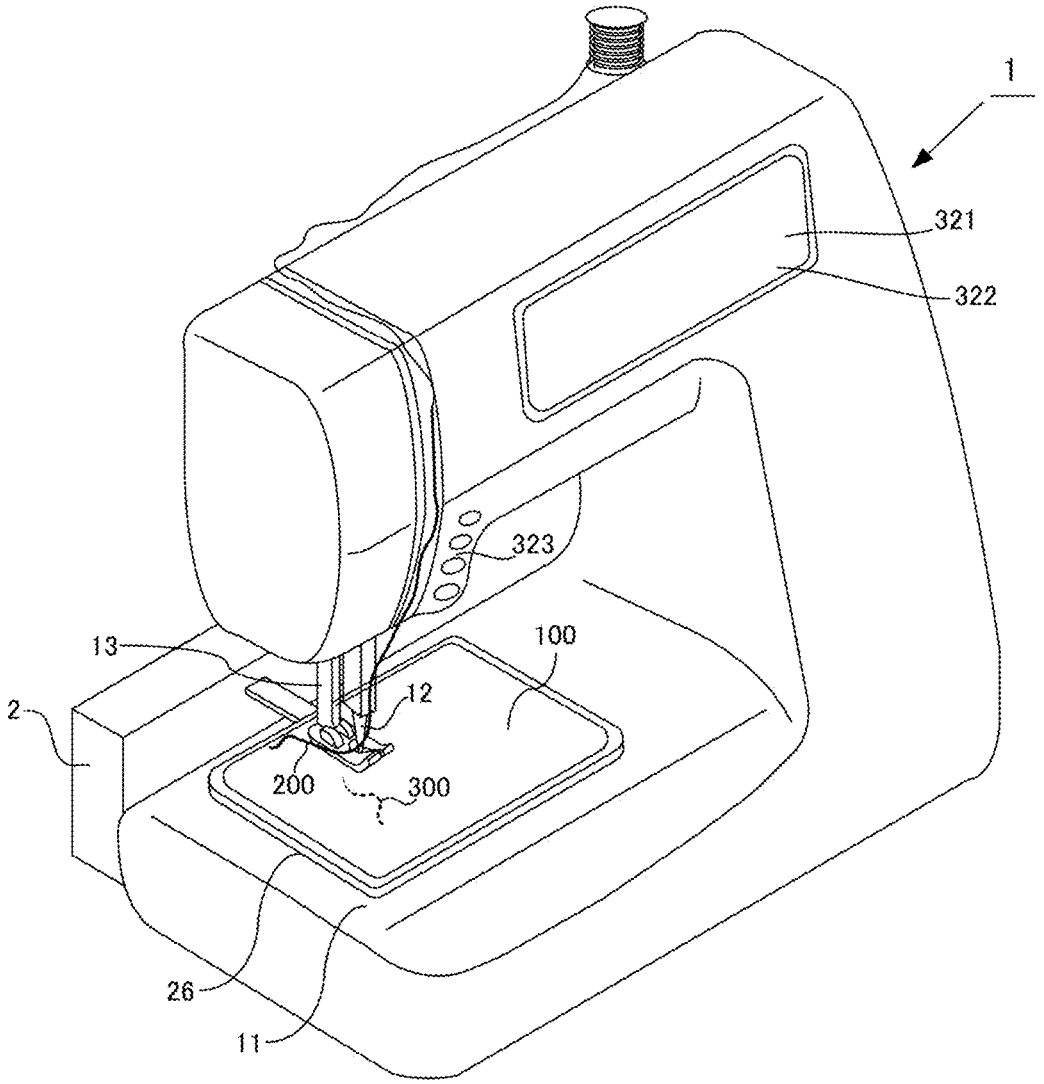
FIG. 1 is a diagram illustrating an entire structure of the external appearance of a sewing machine.

A sewing machine 1 illustrated in FIG. 1 is a household, professional, or industrial device that embroiders on a sewing object such as a cloth or a leather. This sewing machine 1 inserts and removes a needle 12 relative to a sewing object 100 stretched on the plane of the bed unit 11, forming seams to the sewing object 100. A seam is formed by intertwining a needle thread 200 and a bobbin thread 300 with each other. This sewing machine 1 includes a frame driving device 2. The frame driving device 2 horizontally moves a embroidery frame 26, which is the sewing objects 100 horizontally stretched, above the bed unit 11. The sewing machine 1 that includes the frame driving device 2 horizontally moves the embroidery frame 26 and changes the seam forming position on the sewing object 100.

(Sewing Machine Body)

Figure 2:
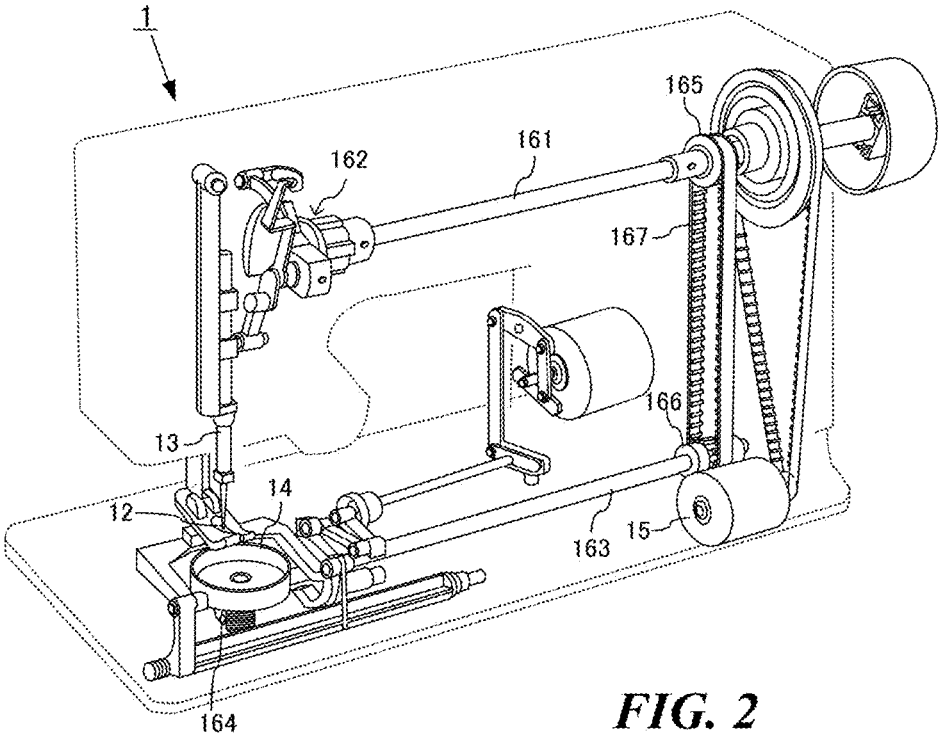
FIG. 2 is a diagram illustrating an internal structure of the sewing machine.

As illustrated in FIG. 2, the sewing machine 1 includes a needle bar 13 and a shuttle 14. The needle bar 13 extends in the direction vertical to the plane of the bed unit 11, and reciprocates in the axial direction. This needle bar 13 supports the needle 12 that holds the needle thread 200 at the end located at the bed-unit-11 side. The shuttle 14 is has a drum shape with a hollow interior and with one plane opened, is attached horizontally or vertically, and can be turned in the circumferential direction. In this embodiment, the shuttle 14 is attached horizontally. This shuttle 14 holds therein the bobbin around which the bobbin thread 300 is wound.

In this sewing machine 1, by the vertical movement of the needle bar 13, the needle 12 with the needle thread 200 penetrates the sewing object 100 and a needle-thread loop is formed due to a friction caused between the sewing object 100 and the needle thread 200 when the needle 12 moves up. Next, the needle-thread loop is trapped by the rotating shuttle 14, and the bobbin that has supplied the bobbin thread 300 passes through the needle-thread loop along with the rotation of the shuttle 14, so that the needle thread 200 and the bobbin thread 300 are intertwined with each other to form a seam.

The needle bar 13 and the shuttle 14 are driven via various transmission mechanisms with a common sewing-machine motor 15 being a drive source. An upper shaft 161 extending horizontally is connected to the needle bar 13 via a crank mechanism 162. The crank mechanism 162 converts the rotation of the upper shaft 161 into linear motion, and transmits it to the needle bar 13 to move the needle bar 13 up and down. A lower shaft 163 extending horizontally is connected to the shuttle 14 via a gear mechanism 164. When the shuttle 14 is installed horizontally, for example, the gear mechanism 164 is a cylindrical worm gear that has an axial angle of 90 degrees. The gear mechanism 164 converts the rotation of the lower shaft 163 by 90 degrees and transmits it to the shuttle 14 to rotate the shuttle 14 horizontally.

A pulley 165 having a predetermined number of teeth is provided to the upper shaft 161. In addition, a pulley 166 having the same number of teeth as the pulley 165 of the upper shaft 161 is provided to the lower shaft 163. Both the pulleys 165 and 166 are linked with each other via a toothed belt 167. When the upper shaft 161 rotates along with the rotation of the sewing-machine motor 15, the lower shaft 163 also rotates via the pulley 165 and the toothed belt 167. This enables the needle bar 13 and the shuttle 14 to operate synchronously.

(Frame Driving Device)

Figure 3:
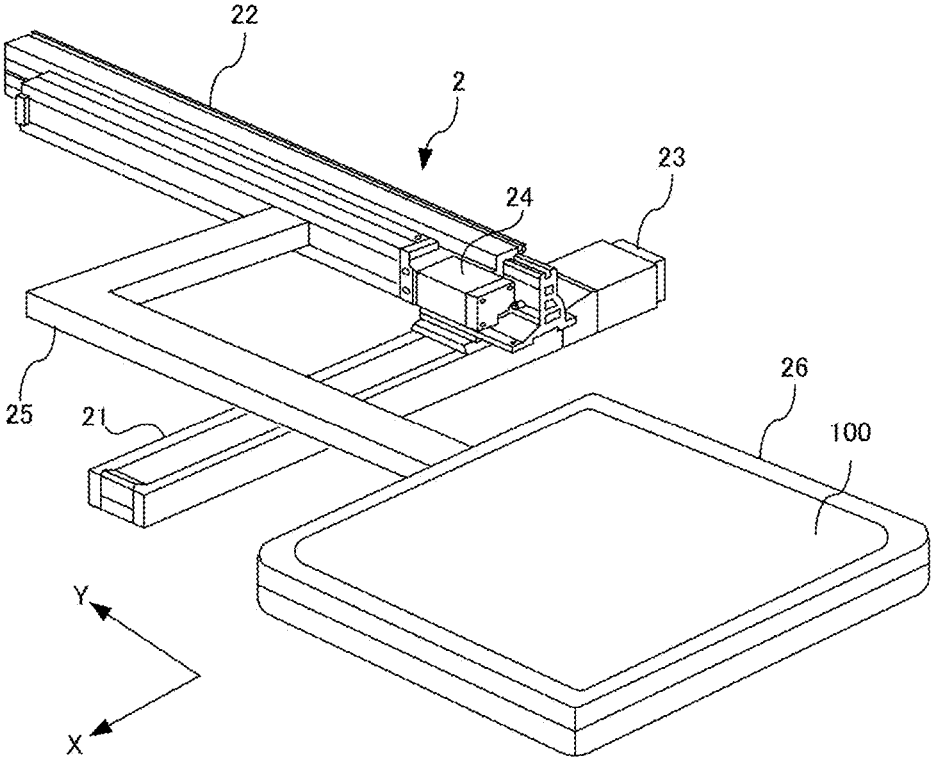
FIG. 3 is a diagram illustrating a detailed structure of a frame driving device.

As illustrated in FIG. 3, the frame driving device 2 may be attached to the sewing machine 1, or may be installed inside the sewing machine 1. The frame driving device 2 holds the embroidery frame 26 by a embroidery frame arm 25, and includes an X linear slider 21 that moves the embroidery frame 26 in an X-axis direction, and a Y linear slider 22 that moves the embroidery frame 26 in a Y-axis direction. The X-axis direction is a lengthwise direction of the bed unit 11, and is generally the right and left direction of the user, while the Y-axis direction is a widthwise direction of the bed unit 11, and is generally the back-and-forth direction of the user.

The embroidery frame 26 includes an inner frame and an outer frame, holds and fixes the sewing object 100 between the inner frame and the outer frame by fitting the outer frame to the inner frame which the sewing object 100 is placed. The sewing object 100 is positioned on the plane of the bed unit 11 so as to be movable horizontally along the fixed planar direction by the frame driving device 2.

(Control Device)

Figure 4:
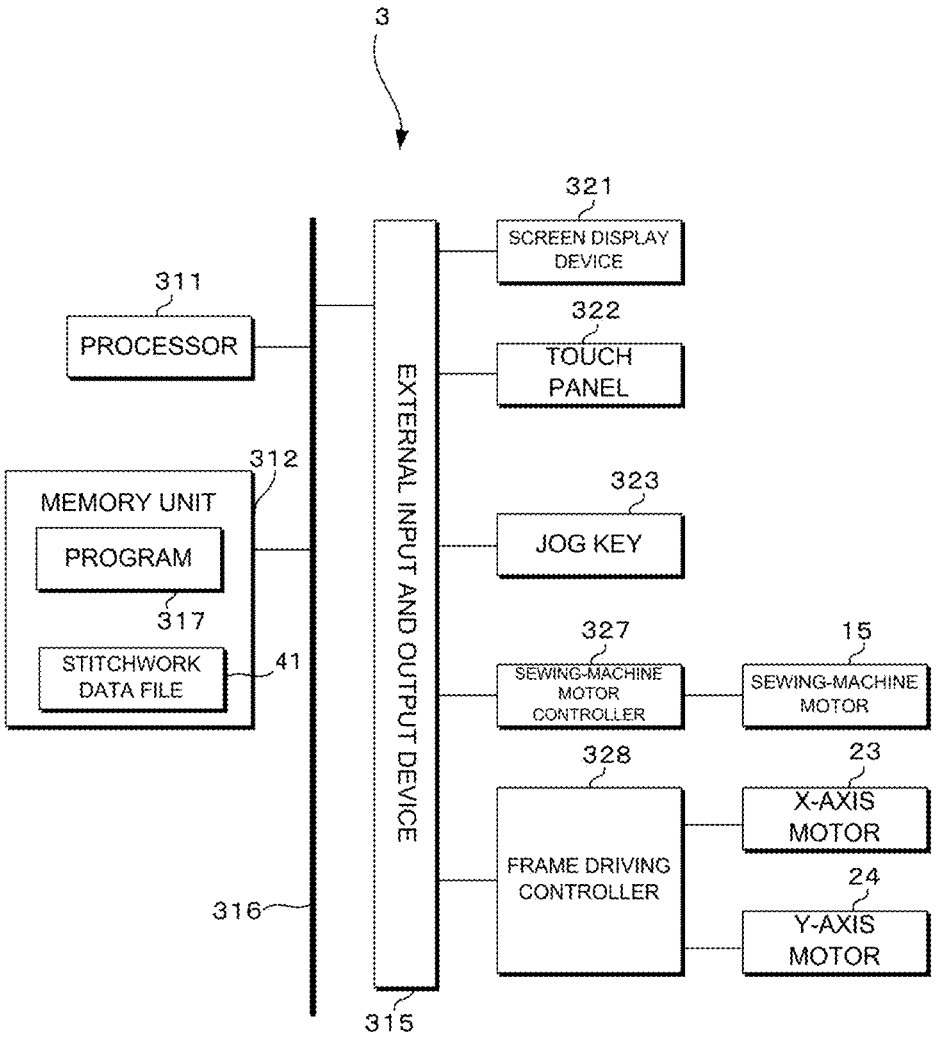
FIG. 4 is a block diagram illustrating a hardware structure of a control device for the sewing machine.

As illustrated in FIG. 4, the sewing machine 1 includes a control device 3 that controls the sewing machine 1 and the frame driving device 2. The control device 3 includes so-called computer and peripheral controller. This control device 3 includes a processor 311 such as a CPU, a memory unit 312 including a hard disk, an SSD, a non-volatile memory such as a flash memory, and a volatile memory, and an external input and output device 315 such as an I/O port. Those are connected with each other via a bus 316. In addition, the control device 3 is connected with a screen display device 321, a touch panel 322, a jog key 323, a sewing-machine motor controller 327, and a frame driving controller 328 via the external input and output device 315. The screen display device 321 and the touch panel 322 are integrated, and form a touch panel screen.

The memory unit 312 stores a program 317 for sewing and embroidery data file 41. The processor 311 executes the program 317 and the embroidery data file 41 as appropriate. Next, the processor 311 outputs control signals via the external input and output device 315 in accordance with the execution result of the program 317. In addition, user operation signals are input to the processor 311 by a request and an interruption given to the touch panel 322 and the jog key 323, etc.

The screen display device 321 is a man-machine interface, such as a liquid crystal display or an organic EL display. This screen display device 321 transforms the layout of display data transmitted from the processor 311 into a format that can be visually understood by the user, such as letters and figures, and displays such data. The touch panel 322 is a pressure-sensitive or electrostatic type input device that transmits a signal in accordance with the touch operation of the user to the processor 311. The jog key 323 is a physical input device that transmits a signal in accordance with a user operation to the processor 311, and is mainly used for a manual operation of the embroidery frame 26.

The sewing-machine motor controller 327 is connected to the sewing-machine motor 15 via signal lines. The sewing-machine motor controller 327 rotates the sewing-machine motor 15 at the speed indicated by the control signal, or stops the sewing-machine motor 15, in response to the control signal from the processor 311. The frame driving controller 328 is connected to an X-axis motor 23 of the frame driving device 2 and a Y-axis motor 24 thereof via signal lines. The frame driving controller 328 drives the X-axis motor 23 and the Y-axis motor 24 by a moving amount indicated by the control signal, in response to the control signal from the processor 311.

Figure 5:
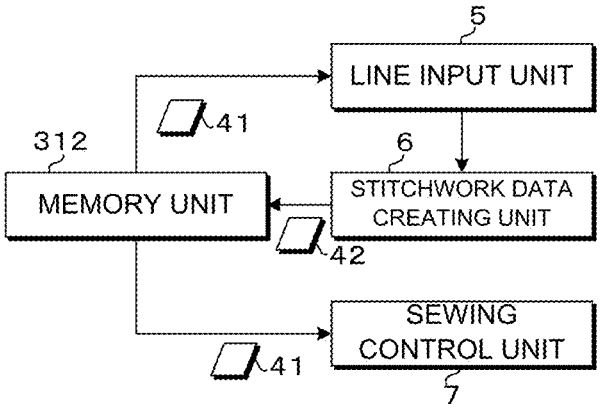
FIG. 5 is a block diagram illustrating a software structure of the control device for the sewing machine.

FIG. 5 is a block diagram illustrating the details of the control device 3 realized by execution of the program 317. As illustrated in FIG. 5, the control device 3 includes, in addition to the memory unit 312 that stores the embroidery data file 4, a line input unit 5, an embroidery data creating unit 6, and a sewing control unit 7, upon execution of the program 317. The line input unit 5 mainly includes the touch panel 322, the processor 311, and the screen display device 321. The embroidery data creating unit 6 mainly includes the processor 311. The sewing control unit 7 mainly includes the processor 311, the sewing-machine motor controller 327, and the frame driving controller 328.

The line input unit 5 receives selection of the motifs to be arranged on the sewing object 100, and input of a line 402 (see FIG. 8) that is the motifs arranged on the sewing object 100, in a motif sequential sewing mode. The motif sequential sewing mode moves the embroidery frame 26 instead of the feed dog and the user's hand, and executes an ordinary sewing. The motif is a pattern in a size that can be sewn by feeding by the feed dog and a swing of the needle in the lateral direction orthogonal to the feeding direction and the axial direction of the needle bar, and is typically a straight, zig-zag, and decorative pattern prepared beforehand in an ordinary sewing. The line 402 which is the motifs arranged is a straight line or a curved line.

The embroidery data creating unit 6 creates the embroidery data 42 that is the motifs arranged on the line 402 input to the line input unit 5, and adds the created data to the embroidery data file 41. The embroidery data 42 of the motif is contained in the program 317, and stored in the memory unit 312 beforehand.

Figure 6:
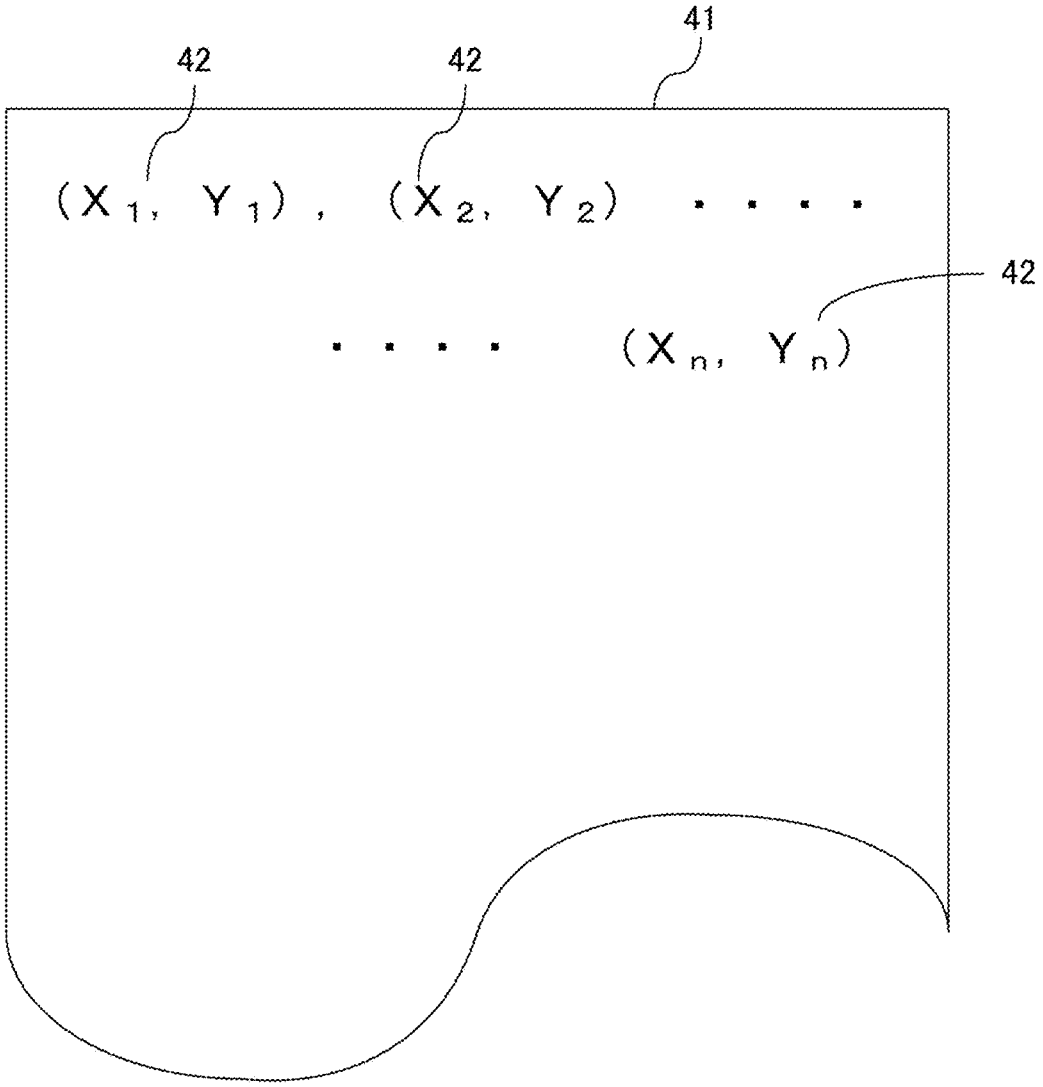
FIG. 6 is an exemplary diagram of embroidery data.

In this case, as illustrated in FIG. 6, the embroidery data file 41 is a collection of embroidery data 42, and the embroidery data 42 expresses each seam positions by the moving amount of the embroidery frame 26 in the X-axis direction and in the Y-axis direction. For example, an embroidery pattern (see FIG. 8) that is a stalk with rosebuds and located at the upper left side, and a rose arranged at the lower right side is expressed by the embroidery data file 41 that is a collection of embroidery data 42 indicating each seam positions forming the stalk by the moving amount in the X-axis direction and in the Y-axis direction, and a collection of the embroidery data 42 indicating each seam positions forming the rose by the moving amount in the X-axis direction and in the Y-axis direction.

The sewing control unit 7 moves the embroidery frame 26 in accordance with the embroidery data file 41 synchronously with the reciprocal motion of the needle bar 13 approaching to the sewing object 100 until a stay sewing process is instructed. That is, when the new embroidery data 42 is added by the line input unit 5 and the embroidery data creating unit 6, the embroidery frame 26 is moved in accordance with the newly added embroidery data 42.

(Operation)

Figure 7:
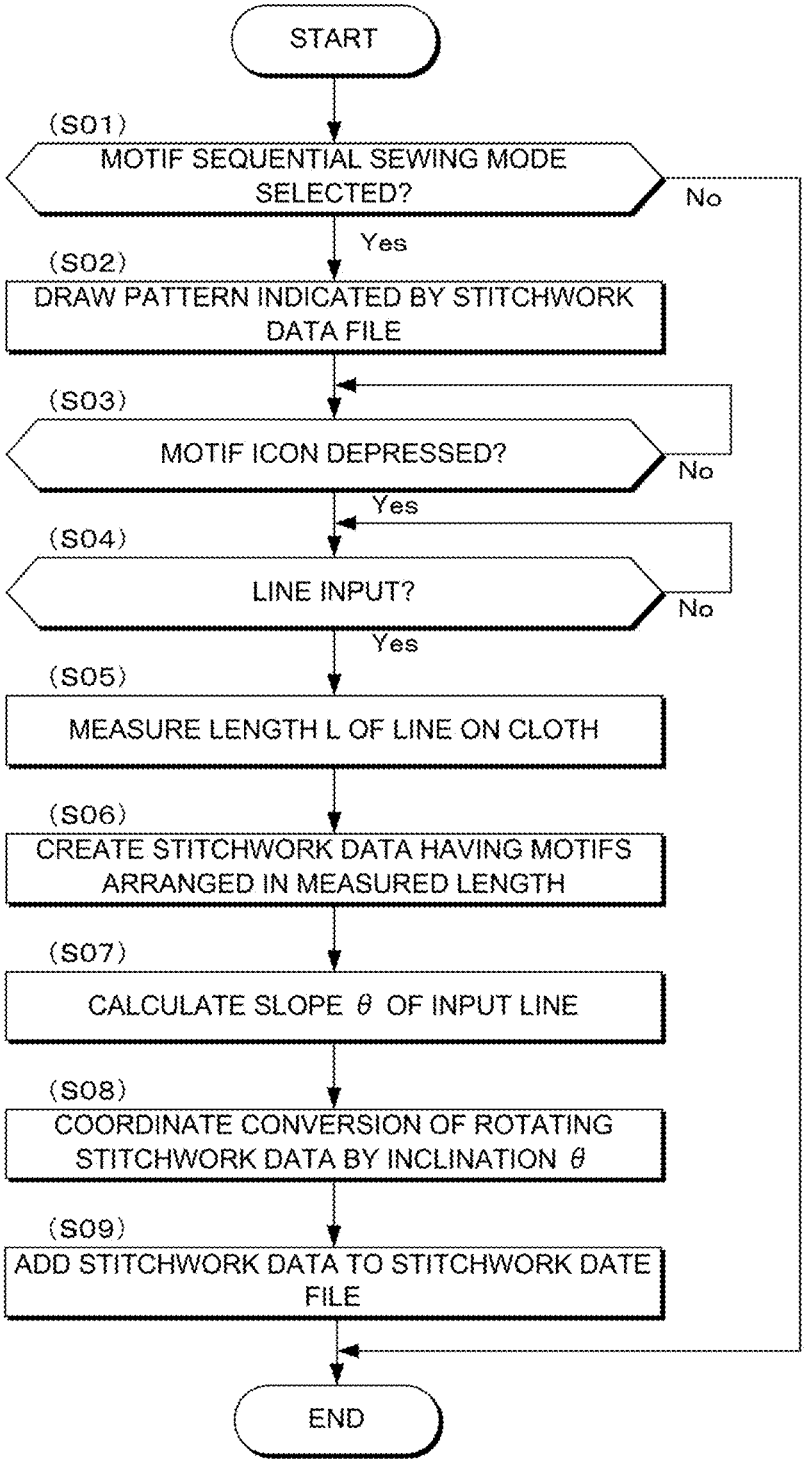
FIG. 7 is a flowchart illustrating an adding operation of the embroidery data.

FIG. 7 is a flowchart illustrating an operation of adding the embroidery data by the control device 3, and as illustrated in FIG. 7, when the touch panel 322 is depressed and the motif sequential sewing mode is selected (step S01: YES), the line input unit 5 draws the pattern indicated by the embroidery data file 41 in the work memory (memory unit) 312 in a line input area 512 of an ordinary sewing execution screen 51 illustrated in FIG. 8 (step S02).

Figure 8:
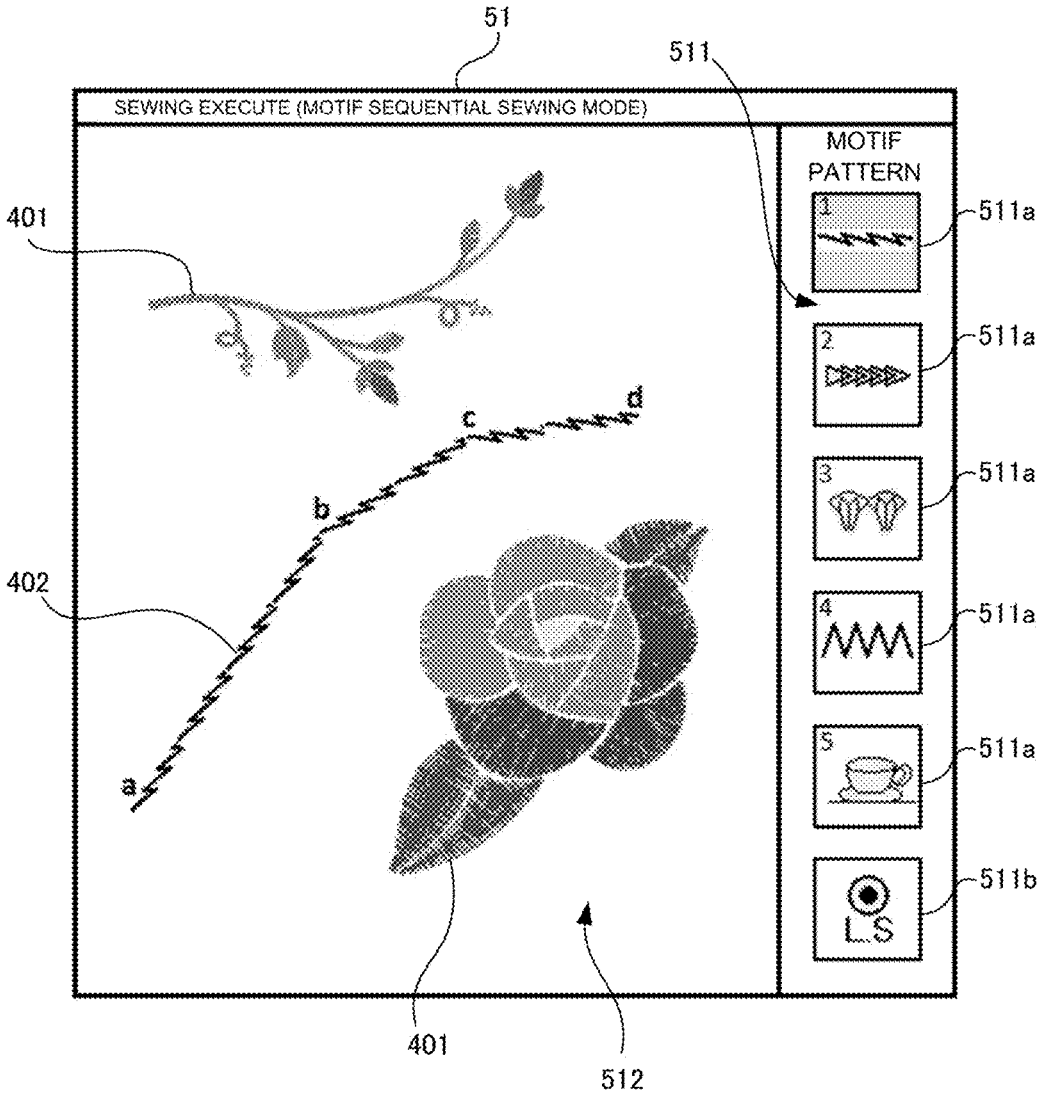
FIG. 8 is an exemplary diagram illustrating an ordinary sewing execution screen.

In this case, in the motif sequential sewing mode, the line input unit 5 displays the ordinary sewing execution screen 51 on the touch panel display including the screen display device 321 and the touch panel 322. As illustrated in FIG. 8, a motif selection area 511 is disposed in the ordinary sewing execution screen 51. Icons 511*a* for various motifs that can be selected in the ordinary sewing mode are arranged in the motif selection area 511. The line input unit 5 sets the motif corresponding to the touched icon 511*a* as the motif to be sewn on the sewing object 100.

In addition, the line input area 512 is disposed in the ordinary sewing execution screen 51. Patterns 401 that is indicated by the current embroidery data file 41 are drawn in the line input area 512. That is, the line input unit 5 displays the rendered entire pattern indicated by the embroidery data file 41 developed in the memory unit 312. In the rendering, the embroidery data 42 stored in the embroidery data file 41 is converted into the coordinate system of the screen, and plots each seam.

In the ordinary sewing execution screen 51, the icon 511*a* in the motif selection area 511 is depressed (step S03: YES), and the line input unit 5 draws the line 402 in the line input area 512 in accordance with the user input (step S04: YES). As for the order of the selection of the icon 511*a* of a motif, and the input of the line 402, either one may be the first.

For example, as illustrated in FIG. 8, when the user touches points a to d on the line input area 512, the line input unit 5 draws the line 402 that passes through touched points a to d. The line input unit 5 connects the touched points a to d by a straight line, or connects the touched points a to d by a smooth curved line. Note that the trajectory traced by the user's finger may be drawn as the line 402 which the motifs are arranged on.

When the line 402 is drawn in the line input area 512, the embroidery data creating unit 6 measures a length L of the drawn line 402, and converts the length L into the scale on the sewing object 100 (step S05). Next, the embroidery data creating unit 6 creates the embroidery data 42 that is motifs associated with the depressed icons 511*a* arranged without a gap in a segment of the length L along the X-axis direction (step S06). Subsequently, the embroidery data creating unit 6 calculates a slope θ of the drawn line 402 in the line input area 512 (step S07), and performs coordinate conversion of turning the created embroidery data 42 by the slope θ (step S08).

More specifically, the length L of a pair of the touched points is calculated from two coordinates of the pair of touched points that has the touched timing adjacent to each other. When the length L is calculated, the embroidery data 42 which is the selected motifs arranged and shifted without a gap in the segment of the length L along the X-axis direction.

At this time, the embroidery data creating unit 6 reads the embroidery data 42 of the motif, and connects the embroidery data 42 in sequence by a number obtained by dividing the length L by the size of the motif. Next, the inclination of the embroidery data 42 that is the motifs arranged in the segment of the length L along the X-axis direction is changed. The slope θ of the line connecting the pair of touched points relative to the X-axis direction may be obtained by obtaining the inner product of the vector of the line connecting the pair of touched points and the vector along the X-axis direction, dividing the inner product by a multiplication result of the scalar of bidirectional vector, and calculating an inverse cosine of the division result.

In addition, an X-coordinate component X' after the inclination change may be calculated by the following formula (1) using the original X-coordinate component X, an original Y-coordinate component Y, and the slope θ. Still further, a Y-coordinate component Y' after the inclination change may be calculated by the following formula (2) using the original X-coordinate component, X, the original Y-coordinate component Y, and the slope θ.

$$X' = X\cos\theta - Y\sin\theta \quad (1)$$

$$Y' = X\sin\theta + Y\cos\theta \quad (2)$$

Finally, the embroidery data creating unit 6 adds the embroidery data 42 that has undergone the coordinate conversion to the embroidery data file 41 (step S09).

Figure 9:
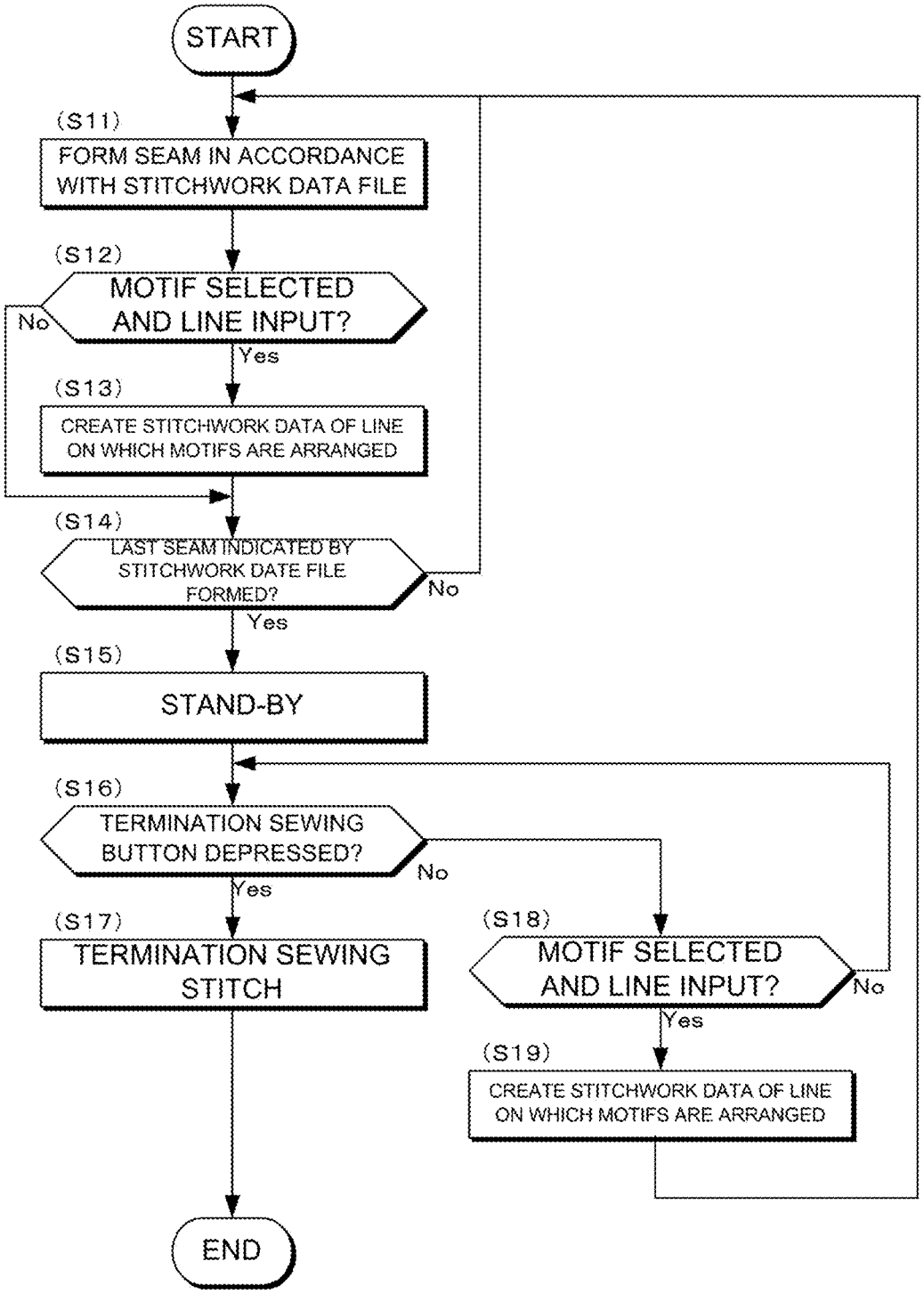
FIG. 9 is a flowchart illustrating a sewing operation.

Next, FIG. 9 is a flowchart illustrating a sewing operation of the control device 3. First, the sewing control unit 7 forms seams on the sewing object 100 in accordance with the embroidery data file 41 (step S11). In the step S11, the sewing control unit 7 reads moving amount information in sequence from the head of the embroidery data file 41, and keeps moving the embroidery frame 26 by the moving amount in the X-axis direction and in the Y-axis direction indicated by the moving amount information until the needle 12 falls in the sewing object 100.

That is, the processor 311 refers to the embroidery data file 41, and transmits the control signals that indicate the moving amount in the X-axis direction and in the Y-axis direction to the frame driving motor controller 328. The frame driving motor controller 328 drives the X-axis motor 23 to match the moving amount in the X-axis direction, and drives the Y-axis motor 24 to match the moving mount in the Y-axis direction, shifting the embroidery frame 26 in the X-axis direction by the moving mount in the X-axis direction, and in the Y-axis direction by the moving mount in the Y-axis direction.

During the sewing, when the user inputs the selection of the icon 511*a* for the motif and the shape of the line 402 (step S12: YES), the embroidery data creating unit 6 creates the embroidery data 42 that is the motifs arranged on the line 402 input by the user (step S13). In these step S12 and step S13, the processes by the line input unit 5 and the embroidery data creating unit 6 illustrated in FIG. 7 are executed.

When the seams indicated by the embroidery data file 41 is formed till the end (step S14: YES), the sewing control unit 7 stops the sewing-machine motor 15 and the frame driving device 2, and becomes a stand-by state (step S15). In the stand-by state, when a stay sewing button 511*b* illustrated in FIG. 8 is depressed (step S16), a stay sewing is performed on the sewing object 100 (step S17), and the sewing process is terminated. As illustrated in FIG. 8, in the ordinary sewing execution screen 51, the stay sewing button 511*b* is provided in the motif selection area 511.

Conversely, in the stand-by state, when the user inputs the selection of the icon 511*a* for the motif and the shape of the line 402 (step S18: YES), the embroidery data creating unit 6 creates the embroidery data 42 that is the motifs arranged on the line 402 input by the user (step S19), and returns to the step S11, and forms seams on the sewing object 100 in accordance with the newly added embroidery data 42. In these step S18 and step S19, the processes by the line input unit 5 and the embroidery data creating unit 6 illustrated in FIG. 8 are executed.

As described above, in the motif sequential sewing mode, the control device 3 accepts, during the sewing, the formation of the line 402 which includes addition of the line 402 by the user until the stay sewing button 511*b* is depressed, and keeps arranging the motifs in sequence along the line 402 every time the line 402 is updated.

(Action)

Figure 10A:
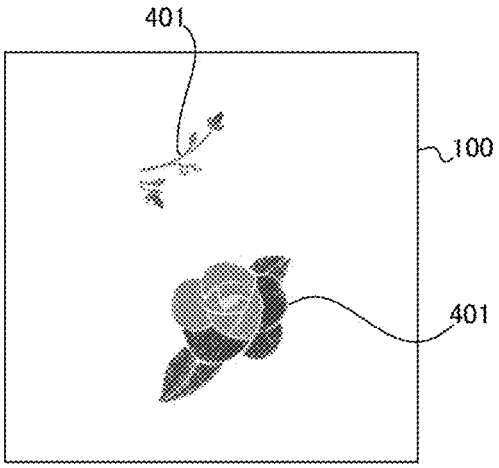
FIGS. 10A to 10C are each an exemplary diagram illustrating a transition of a pattern sewn on a sewing object.

As illustrated in FIG. 10A, it is assumed that a pattern 401 of a rose stalk with rosebuds and a pattern 401 of rose are being sewn on the sewing object 100. The embroidery data 42 for the pattern 401 of stalk and the embroidery data 42 for the pattern 401 of flower are contained in the single embroidery data file 41, and by performing sewing in accordance with this embroidery data file 41, the pattern 401 for rose stalk and the pattern 401 for rose are sewn on the sewing object 100.

Figure 11A:
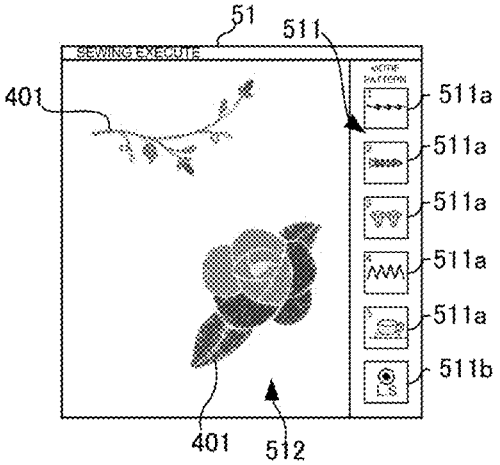
FIGS. 11A to 11D are each an exemplary diagram illustrating a transition of the ordinary sewing execution screen in accordance with a user operation.

It is also assumed that the user wants to put segment lines roughly along the contour of rose flower by zig-zag pattern to a region between the pattern 401 of stalk and the pattern 401 of flower. In this case, the motif sequential sewing mode is selected to display the ordinary sewing execution screen 51 illustrated in FIG. 11A on the screen display device 321. This ordinary sewing execution screen 51 shows, in the line input area 512, the rose stalk and the rose formed on the sewing object 100 by rendering the embroidery data file 41 that disposes the rose stalk and the rose.

Figure 11B:
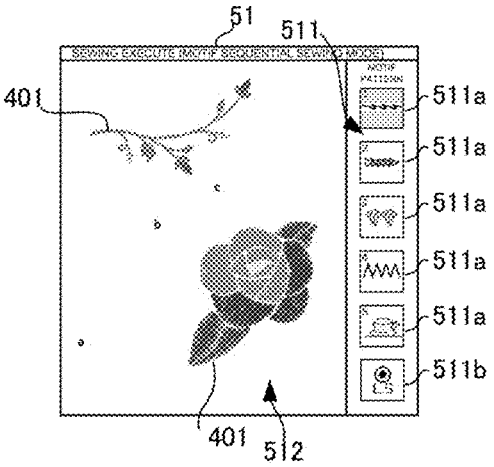
Figure 12A:
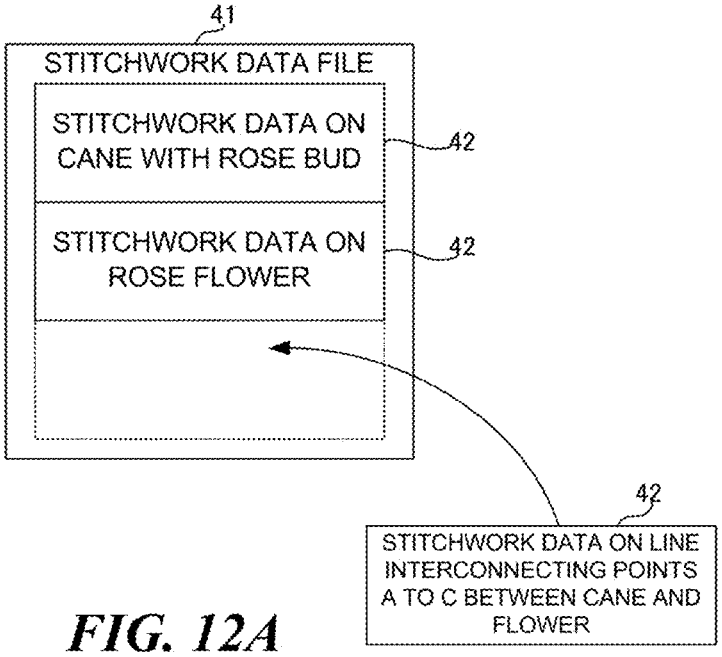
FIGS. 12A and 12B are each an exemplary diagram illustrating a transition of an embroidery data file.

The user images lines with reference to the rose stalk and the rose in the line input area 512, and as illustrated in FIG. 11B, touches points on the line input area 512 corresponding to points a to c on the line. In addition, the user touches the icon 511*a* drawn with a zig-zag pattern from the motif selection area 511. Hence, as illustrated in FIG. 12A, the embroidery data creating unit 6 creates the embroidery data 42 which is zig-zag patterns arranged on the lines connecting the touched points a to c in the line input area 512, and adds the created embroidery data 42 to the embroidery data file 41 which the embroidery data 42 of rose stalk with rosebuds and the embroidery data 42 of rose are disposed.

Figure 10B:
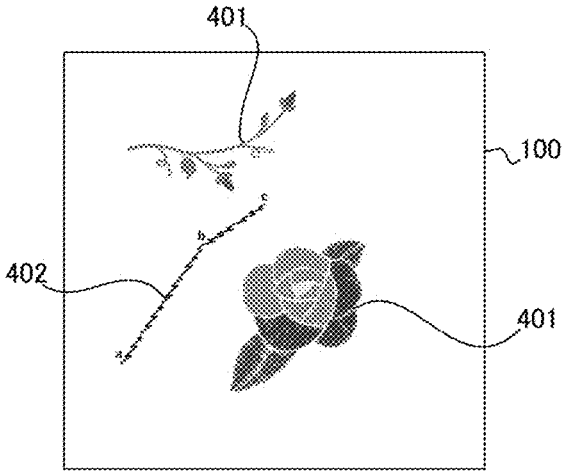
Figure 11C:
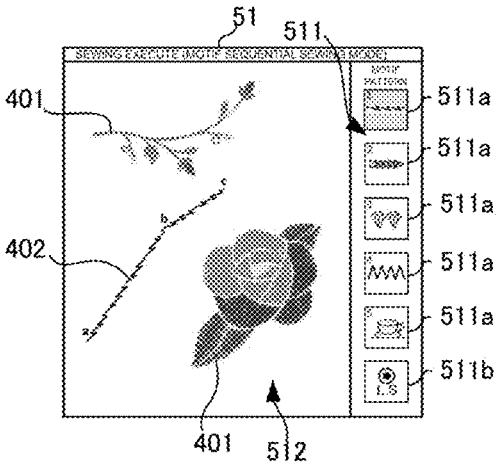

As illustrated in FIG. 11C, when the embroidery data 42 that is the line which the zig-zag patterns are arranged in sequence is created, the line input unit 5 draws the line 402 which the zig-zag patterns are arranged in sequence in the line input area 512. As illustrated in FIG. 10B, when the embroidery of the patterns 401 that is the rose stalk and the rose is completed, the sewing control unit 7 restart the sewing machine 1 if in the stand-by state, moves the embroidery frame 26 in accordance with the embroidery data 42 added in the embroidery data file 41 synchronously with the reciprocal motion of the needle bar 13, and sews the line 402 in the zig-zag patterns arranged in sequence and passing through the points a to c on the sewing object 100.

Figure 11D:
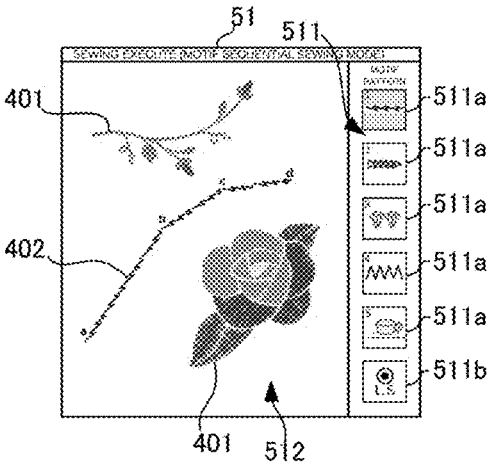
Figure 12B:
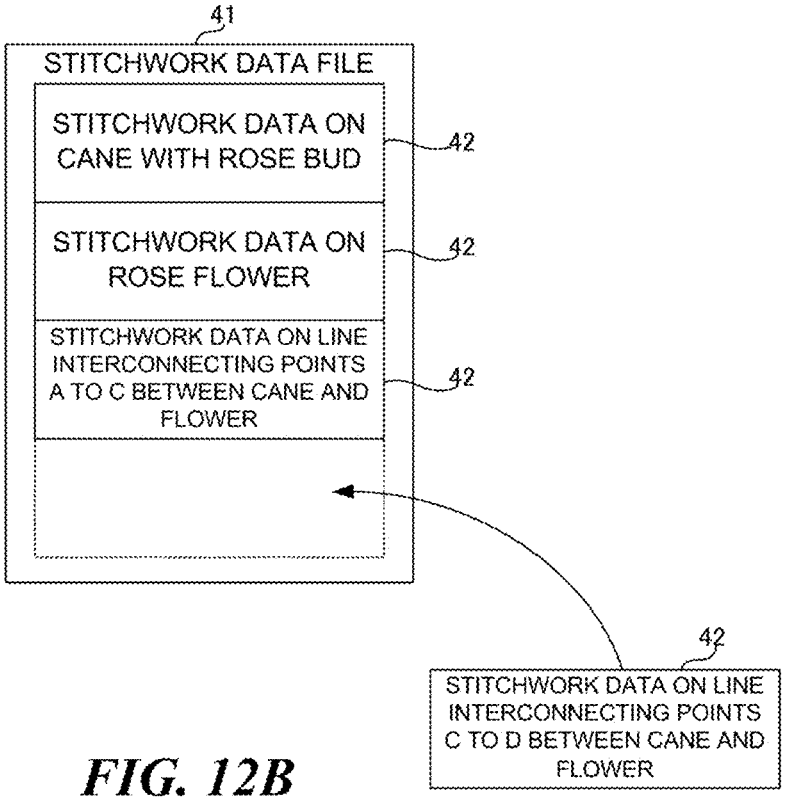

Still further, as illustrated in FIG. 11D, it is assumed that the user wants to extend the line 402 with the reference to the rose stalk and the rose in the line input area 512, and touches a point corresponding to an end point d the line is extended to in the line input area 512. Hence, as illustrated in FIG. 12B, the embroidery data creating unit 6 additionally creates the embroidery data 42 that is the zig-zag patterns arranged on the line 402 which connects the original end point c and the extended end point d, and adds the created data to the embroidery data file 41 which the rose stalk and rose are arranged. As illustrated in FIG. 11D, the line input unit 5 draws which is extended by the zig-zag pattern to the line 402 extended in the line input area 512.

Figure 10C:
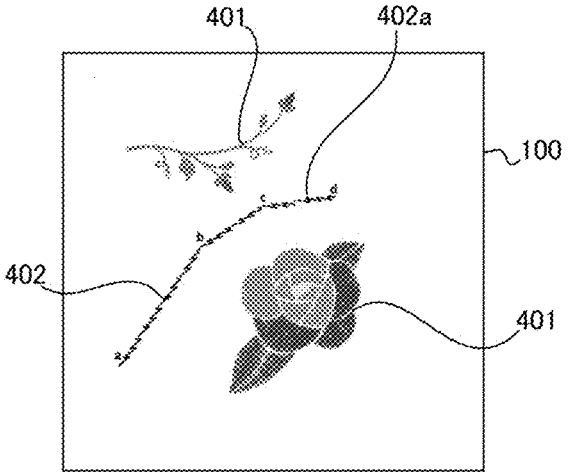

As illustrated in FIG. 10C, when the patterns 401 which is the rose stalk and the rose, and the original line 402 has been sewn, the sewing control unit 7 drives the sewing machine 1, moves the embroidery frame 26 in accordance with the embroidery data 42 added in the embroidery data file 41 synchronously with the reciprocal motion of the needle bar 13, and sews an additional line 402*a* which the zig-zag patterns are arranged in sequence on the sewing object 100.

(Effect)

As described above, this sewing machine 1 includes the embroidery frame 26 that moves horizontally while stretching and supporting the sewing object 100, the needle bar 13 that supports the needle 12 that inserts a thread to the sewing object 100, and that reciprocally moves relative to the sewing object 100 stretched by the embroidery frame 26, and the control device 3 that controls the horizontal movement of the embroidery frame 26 and the reciprocal motion of the needle bar 13.

This control device 3 includes the line input unit 5 that accepts selection of the motif and input of the line 402 which the motifs are arranged in sequence. In addition, the control device 3 horizontally moves the embroidery frame 26 in a way that the motifs selected by using the line input unit 5 are arranged in sequence along the line 402 on the sewing object 100. The motif is a pattern in a size that can be sewn by feeding by the feed dog and the needle swing in the lateral direction orthogonal to the axial direction of the needle bar 13, and is, for example, a straight line, zig-zag, or decorative pattern that can be selected in an ordinary sewing mode.

Hence, the motifs can be arranged in sequence along the line 402 as imaged by the user by the movement of the embroidery frame 26 without the user changing the direction of the sewing object 100 by placing hands on the sewing object 100. In addition, it is unnecessary to prepare the embroidery data 42 of the line 402 which the motifs are arranged using the data input device beforehand, and to cause the sewing machine 1 to read the data. Hence, this sewing machine 1 does not need a preparation for creating the embroidery data 42 prior to sewing, and easily achieves sewing as imaged by the user without requiring the skill and the concentration of the user.

In addition, the line input unit 5 includes the ordinary sewing execution screen 51 formed by a touch panel screen, and further accepts designation of points on the touch panel screen. When the line input unit 5 accepts designation of the additional points while arranging the motifs on the sewing object 100, the control device 3 horizontally moves the embroidery frame 26 so as to arrange the motifs in sequence on the sewing object 100 along the line 402 extended toward the additional point.

Still further, when the line input unit 5 accepts designation of an additional point after arrangement of motifs along the shape of the line 402 has been completed, the control device 3 restarts the horizontal movement of the embroidery frame 26 and the reciprocal motion of the needle bar 13 so as to arrange the motifs in sequence on the sewing object 100 along the shape of the extended line 402 toward the additional point.

According to conventional technology, if it is attempted to change the original embroidery pattern, it is necessary to once wait for completion of the embroidery pattern, and then to change the embroidery data file 41. When, for example, the user wants to put the line 402 of the zig-zag pattern at the boundary between the pattern 401 of the rose stalk and the rose after the pattern 401 is sewn, it is necessary for the user to add the embroidery data 42 indicating the line 402 of the zig-zag pattern to the embroidery data file 41 for the pattern 401 of rose stalk and rose after the embroidery for the rose stalk and the rose is completed, delete the embroidery data 42 on rose stalk and rose, cause the control device 3 to read the newly created embroidery data 42, and add the line 402 of the zig-zag pattern.

In addition, when the user wants to extend the line 402, it is necessary for the user to contain the embroidery data 42 of the additional line 402 in the embroidery data file 41 indicating the line 402 of the zig-zag pattern, and delete the embroidery data 42 of the original line 402. In order to avoid the time-consuming repetition of changing and sewing of the embroidery data file 41, the user is required to carry out sewing in the ordinary sewing mode which the user puts the hand on the sewing object 100, and feeds the sewing object 100 by the feed dog, requiring the user's skill.

According to the sewing machine 1, however, an additional design imaged by the user along with the progress of sewing can be easily reflected on the sewing, and further facilitating the sewing imaged by the user without the preparation of creating the embroidery data 42 prior to the sewing and regardless of the user's skill and concentration.

In addition, the control device 3 includes the memory unit 312 that stores the embroidery data file 41 containing the embroidery data 42 of the pattern, the embroidery data creating unit 6 that creates the embroidery data 42 that is the motifs arranged in sequence along the shape of the line 402, and that adds the created embroidery data to the embroidery data file 41, the screen display device 321 that displays the rendered pattern indicated by the embroidery data file 41, and the X-axis motor 23 and the Y-axis motor 24 that horizontally move the embroidery frame 26 in accordance with the embroidery data 42 contained in the embroidery data file 41.

Accordingly, since the user can instruct the line 402 which the motifs are arranged on in sequence in view of the positional relation of each embroidery patterns to be sewn presently, the imaged line can be added precisely.

(Modified Example)

The line 402 which the motifs are arranged on in sequence may be indicated by the needle 12 at an actual position on the sewing object 100 in addition to a touch input on the touch panel screen. In this sewing machine 1, the line input unit 5 mainly includes the jog key 323, the frame driving controller 328, and the frame driving device 2. This line input unit 5 moves the embroidery frame 26 in response to an operation given of the jog key 323, and captures the point on the sewing object 100 indicated by the needle 12. The embroidery data creating unit 6 creates, when at least two points on the sewing object 100 are indicated, the embroidery data 42 that is the motifs arranged in sequence on the line 402 that connects the two points.

The line input unit 5 may also utilize the ordinary sewing execution screen 51, display the point indicated by the needle 12 in the line input area 512, and draw the line that connects two points when the two points are indicated.

This modified example is especially advantageous in cases there is a decoration which is to be sewn on the sewing object 100 other than the line 402, and which is not contained in the embroidery data file 41. The line 402 can be determined while checking the positional relation with the decoration. Example decorations are embroidery already sewn and not contained in the embroidery data file 41, and other cloths, such as a pocket and an applique, not contained in the embroidery data file 41.

(Other Embodiments)

Embodiments of the present disclosure have been described above, and various omissions, replacements, and modifications can be made thereto without departing from the scope of the present disclosure. Such embodiments and modified forms thereof are within the scope of the present disclosure, and are also within the scope of the invention as recited in the appended claims and the equivalent range thereto.

What is claimed is:

1. A sewing machine comprising:

an embroidery frame that moves horizontally while stretching and supporting a sewing object;

a needle bar that supports a needle that penetrates a needle thread in the sewing object, and that reciprocally moves relative to the sewing object stretched by the embroidery frame;

a control unit that controls the horizontal movement of the embroidery frame and the reciprocal motion of the needle bar; and an input unit that accepts selection of a motif and input of a line which the motifs are arranged on in sequence, wherein the control unit horizontally moves the embroidery frame in way that the motifs are arranged in sequence on the sewing object along the line, and wherein the control unit horizontally moves the embroidery frame and reciprocally moves the needle bar so as to arrange the motifs in sequence on the sewing object along a shape of the line extended toward an additional point, the input unit accepts designation of the additional point while arranging the motifs on the sewing object.

2. The sewing machine according to claim 1, wherein the motif is a straight line, zig-zag, or decorative pattern.

3. The sewing machine according to claim 1, wherein:

the input unit further comprises a touch panel screen, and accepts designation of points on the touch panel screen; and the control unit horizontally moves the embroidery frame and reciprocally moves the needle bar so as to arrange the motifs in sequence on the sewing object along the shape of the line that connects the designated points.

4. The sewing machine according to claim 3, wherein the control unit restarts the horizontal movement of the embroidery frame and the reciprocal motion of the needle bar in a way that the motifs are arranged in sequence on the sewing object along the shape of the line extended toward an additional point, the input unit accepts designation of the additional point after arrangement of motifs along the shape of the line is completed.

5. The sewing machine according to claim 3, wherein the control unit comprises:

a creating unit that creates embroidery data which is the motifs arranged in sequence along the shape of the line; and an actuator that horizontally moves the embroidery frame in accordance with the embroidery data.

6. The sewing machine accordingly to claim 3, wherein:

the control unit comprises:

a creating unit that creates embroidery data file containing embroidery data which is the motifs arranged in sequence along the shape of the line; and an actuator that horizontally moves the embroidery frame in accordance with the embroidery data contained in the embroidery data file, and the creating unit creates, when the input unit accepts designation of an additional point, the embroidery data that is the motifs arranged in sequence in a segment extended up to the additional point, and adds the created embroidery data to the embroidery data file.

7. The sewing machine according to claim 3, wherein the control unit comprises:

a memory unit that stores embroidery data file containing embroidery data of a pattern;

a creating unit that creates the embroidery data that is the motifs arranged in sequence along the shape of the line, and that adds the created embroidery data to the embroidery data file;

a display unit that displays the rendered pattern indicated by the embroidery data file; and an actuator that horizontally moves the embroidery frame in accordance with the embroidery data contained in the embroidery data file.

8. The sewing machine according to claim 1, wherein:

the input unit comprises a jog key that horizontally moves the embroidery frame in response to a user operation, and further accepts designation of points on the sewing object indicated by the needle; and the control unit horizontally moves the embroidery frame and reciprocally moves the needle bar so as to arrange the motifs in sequence on the sewing object along the shape of the line that connects the indicated points.

* * * * *